US007081863B2

(12) United States Patent
Inasawa et al.

(10) Patent No.: US 7,081,863 B2
(45) Date of Patent: Jul. 25, 2006

(54) REFLECTOR ANTENNA

(75) Inventors: Yoshio Inasawa, Tokyo (JP); Shinji Kuroda, Tokyo (JP); Yoshihiko Konishi, Tokyo (JP); Shigeru Makino, Tokyo (JP); Kenji Kusakabe, Tokyo (JP); Izuru Naito, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/526,220

(22) PCT Filed: Dec. 25, 2003

(86) PCT No.: PCT/JP03/13776

§ 371 (c)(1),
(2), (4) Date: Mar. 1, 2005

(87) PCT Pub. No.: WO2005/018049

PCT Pub. Date: Feb. 24, 2005

(65) Prior Publication Data

US 2006/0001588 A1 Jan. 5, 2006

(30) Foreign Application Priority Data

Aug. 13, 2003 (JP) ..... 2003-292760

(51) Int. Cl.
*H01Q 13/00* (2006.01)

(52) U.S. Cl. ..... 343/781 CA; 378/8

(58) Field of Classification Search ..... 343/781 P, 343/781 CA
See application file for complete search history.

(56) References Cited

U.S. PATENT DOCUMENTS 3,696,436 A 10/1972 Yokoi et al.
4,338,607 A * 7/1982 Drabowitch ..... 343/754
5,182,569 A * 1/1993 Bui-Hai ..... 343/781 CA
5,373,302 A * 12/1994 Wu ..... 343/781 P
5,796,370 A * 8/1998 Courtonne et al. ..... 343/781 R (Continued)

FOREIGN PATENT DOCUMENTS

DE 23 59 870 6/1975

(Continued)

OTHER PUBLICATIONS

Tom Milligan, IEEE Antennas and propagation Magazine, vol. 41, No. 6, Dec. 1999.

(Continued)

*Primary Examiner*—Tan Ho
(74) *Attorney, Agent, or Firm*—Birch, Stewart, Kolasch & Birch, LLP

(57) ABSTRACT

A reflector antenna device includes: an auxiliary reflector 1 that receives an electric wave radiated from an opening portion by a primary radiator 3 and reflects the electric wave; and a main reflector 2 that receives the electric wave that is reflected by the auxiliary reflector 1 and radiates the electric wave to a space. In the reflector antenna device, the configurations of the auxiliary reflector 1 and the main reflector 2 are designed such that an electric power in an area of the main reflector 2 where the auxiliary reflector 1 is projected on the main reflector 2 in parallel with the radiating direction of the electric wave due to the main reflector 2 is equal 1 or lower than a predetermined first threshold value, and a radiation pattern of the antenna which is determined by the area of the main reflector 2 other than the area has a desired characteristic.

7 Claims, 12 Drawing Sheets

(a)

(b)

U.S. PATENT DOCUMENTS

| | | | | |
|---|---|---|---|---|
| 6,831,613 | B1 * | 12/2004 | Gothard et al. | 343/779 |
| 6,911,953 | B1 * | 6/2005 | Gothard et al. | 343/781 CA |
| 6,982,679 | B1 * | 1/2006 | Kralovec et al. | 343/781 CA |
| 2003/0151558 | A1 | 8/2003 | Inasawa et al. | |

FOREIGN PATENT DOCUMENTS

| | | | |
|---|---|---|---|
| JP | 63169803 | | 7/1988 |
| JP | 09-284044 | A | 10/1997 |
| JP | 2002-512462 | A | 4/2002 |
| JP | 2002-330020 | A | 11/2002 |

OTHER PUBLICATIONS

Shinichi Nomoto et al., The Article of Institute of Electronics, Information and Communication Engineers, B, vol. J71-B, No. 11, pp. 1338-1344, Nov. 1988.

K. Jakobsen et al. "Scalar Horn Feed With Lens Shaped For Improved Cassegrain Efficiency". 1984 International Symposium—Digest, vol. 2, Jun. 25, 1984- Jun. 29, 1984 pp. 616-619, XP002341915 IEEE, New York, USA.

* cited by examiner (a)

(b)

(a) XZ PLANE (b) YZ PLANE (a) REFLECTOR ON SECTION 1 (XZ PLANE)

(b) REFLECTOR ON SECTION 1 (YZ PLANE)

REFLECTOR ANTENNA

This application is a 371 of PCT/JP03/13776 filed on Dec. 25, 2003.

TECHNICAL FIELD

The present invention relates to an antenna device, and more particularly to a reflector antenna device having two reflector surfaces.

BACKGROUND ART

Conventional reflector antenna devices having two reflectors include those disclosed in, for example, "A Simple Procedure for the Design of Classical Displaced-Axis Dual-Reflector Antennas Using a Set of Geometric Parameters", IEEE Antennas and Propagation Magazine, Vol. 41, No. 6, pp. 64–72, in December, 1999, written by Tom Milligan. An example of the reflector antenna devices disclosed therein is shown in FIG. 12. As shown in FIG. 12, an electromagnetic wave radiated from a primary radiator 3 is reflected by an auxiliary reflector 1, reflected by a main reflector 2, and then radiated to a space. Also, because the configurations of the auxiliary reflector 1 and the main reflector 2 are determined so that the electromagnetic wave that has been radiated from a phase center 4 of the primary radiator 3 geometrical-optically passes through paths of 4-P-Q-R and 4-U-V-W, no electromagnetic wave geometrical-optically arrives in an area A where the auxiliary reflector 1 is projected on the main reflector 2 in parallel with a radiation direction of the electromagnetic wave by means of the main reflector 2.

Also, as another conventional reflector antenna, there has been proposed a reflector which is designed taking into consideration a wave influence on the basis of not geometrical-optical design but physical optics method as disclosed in, for example, Shinichi Nomoto and one other person, "Shaped Reflector Design for Small-Size Offset Dual Reflector Antennas", Electronic information communication society article, November 1988, B Vol. J71-B, No. 11, pp. 1338–1344. In the reflector antenna, a radiation pattern is obtained on the basis of the physical optics method taking the wave influence into consideration, and the performances of both of a gain and a side lobe are optimized by using a non-linear optimization technique.

In the conventional reflector antenna device shown in FIG. 12, although no electromagnetic wave arrives in the area A geometrical-optically, the electromagnetic wave actually arrives due to the wave property of the electromagnetic wave. This phenomenon becomes remarkable as the size of the auxiliary reflector 1 becomes smaller in the wavelength ratio. The electromagnetic wave radiated from the primary radiator 3 is reflected by the auxiliary reflector 1, and undesirably contributes to a scattering wave due to the primary radiator 3, or a multiple reflected wave between the main reflector 2 and the auxiliary reflector 1, due to the influence of the electromagnetic wave that arrives in the area A. As a result, there arises such a problem that the characteristic deterioration of the antenna is induced.

Also, in the above-described document "Shaped Reflector Design for Small-Size Offset Dual Reflector Antennas", although the antenna is designed according to the shaped reflector design based on the physical optics method, only the performance of the antenna is designed as an evaluation function. As a result, there arises such a problem that no attention has been paid to a risk of the deterioration of the performance due to an influence of the electromagnetic wave in the area in which the electromagnetic wave should not arrive geometrical-optically.

DISCLOSURE OF THE INVENTION

The present invention has been made to solve the above problem, and therefore an object of the present invention is to provide a reflector antenna device that suppresses an influence of unnecessary electromagnetic waves and improves performance of an antenna.

In order to achieve the above-mentioned object, the present invention provides a reflector antenna device, including: an auxiliary reflector that receives an electric wave radiated from an opening portion by a primary radiator and reflects the electric wave; and a main reflector that receives the electric wave that is reflected by the auxiliary reflector and radiates the electric wave to a space, wherein the configurations of the auxiliary reflector and the main reflector are designed such that an electric power in an area of the main reflector where the auxiliary reflector is projected on the main reflector in parallel with the radiating direction of the electric wave due to the main reflector is equal to or lower than a predetermined first threshold value, and a radiation pattern of the antenna which is determined by the area of the main reflector other than the area has a desired characteristic.

With the above structure, according to the present invention, the configurations of the auxiliary reflector and the main reflector are designed such that an electric power in an area of the main reflector where the auxiliary reflector is projected on the main reflector in parallel with the radiating direction of the electric wave from the main reflector is equal to or lower than a first predetermined threshold value, and a radiation pattern of the antenna which is determined by an area of the main reflector other than the area has a desired characteristic. As a result, an influence of unnecessary electromagnetic waves is suppressed, making it possible to improve the performance of the antenna.

BEST MODES FOR CARRYING OUT THE INVENTION

First Embodiment

Figure 1:
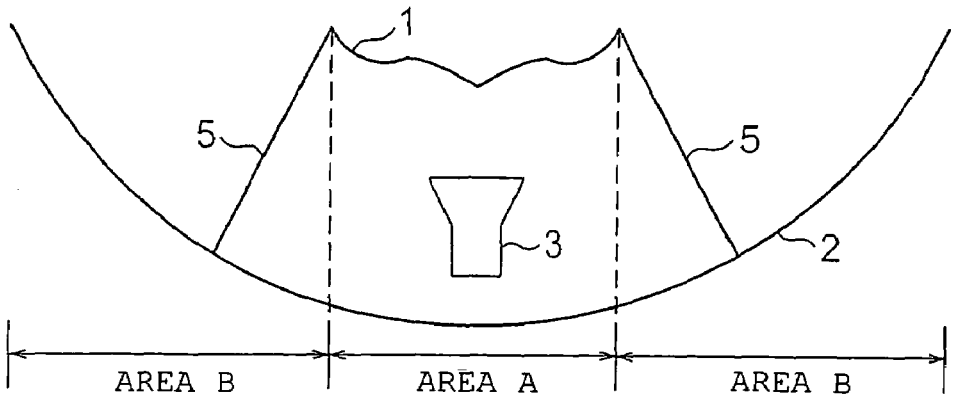
FIG. 1(*a*) is an explanatory diagram showing the structure of a reflector antenna device in accordance with a first embodiment of the present invention, and FIG. 1(*b*) is an explanatory diagram showing an initial configuration and a coordinate system.
Figure 1:
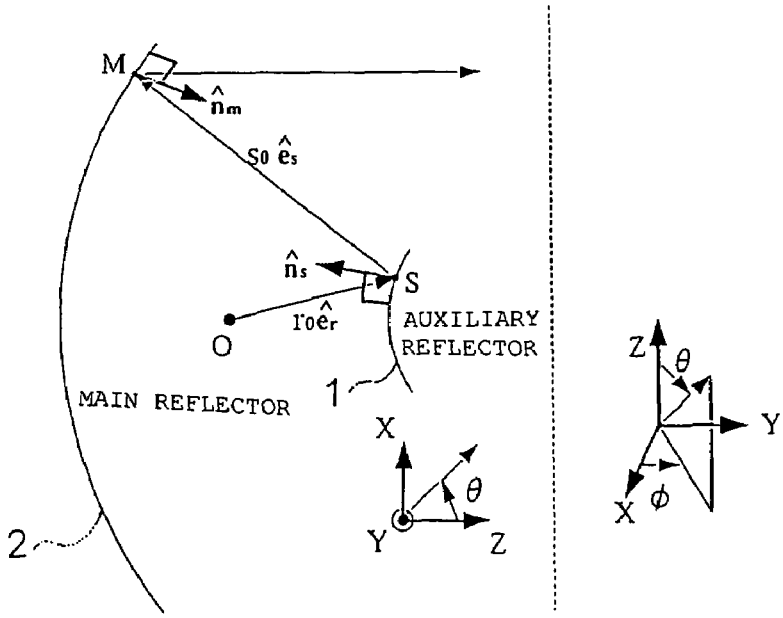

FIG. 1 shows the structure of a reflector antenna device in accordance with a first embodiment of the present invention. As shown in FIG. 1(*a*), the reflector antenna according to the first embodiment is made up of an auxiliary reflector 1 that receives an electric wave (or electromagnetic wave) radiated from a primary radiator 3 and reflects the electric wave, and a main reflector 2 that receives an electric wave reflected from the auxiliary reflector 1 and radiates the electric wave to a space. Also, a stay 5 for spatially supporting the auxiliary reflector 1 is disposed on the main reflector 2.

The electromagnetic wave radiated from the primary radiator 3 is reflected by the auxiliary reflector 1, further reflected by the main reflector 2, and then radiated to the space. In the reflector antenna device, in order to reduce a risk of the deterioration of the performance of an antenna, it is necessary to suppress the intensity of an electromagnetic wave that arrives in an area A of the main reflector 2 where the auxiliary reflector 1 is projected on the main reflector 2 in parallel with the radiating direction of the electromagnetic wave due to the main reflector 2. Also, it is necessary to design the reflector antenna device so that the gain and radiation pattern of the antenna characteristics which are defined by the electromagnetic wave that arrives in an area B of the main reflector 2 other than the area A have a desired characteristic.

Also, it is necessary that the intensity of the electromagnetic wave that arrives in the area A and the antenna characteristic are calculated by not a geometric optics technique, but a technique such as a physical optics method by which an influence of waves can be taken into account.

In order to achieve the above structure, in this embodiment, the configurations of the auxiliary reflector and the main reflector are optimized so as to suppress the intensity of the electromagnetic wave that arrives in the area A to a predetermined level or lower and provide the gain and radiation pattern of the antenna characteristics defined by the electromagnetic wave that arrives in the area B in a main reflector 2 other than the area A with a desired characteristic by a technique by which the influence of the wave can be taken into account such as the physical optics method. Thus, the antenna is designed. It is assumed that the predetermined value related to the intensity of the electromagnetic wave, and the desired characteristic related to the gain and radiation pattern of the antenna characteristic are appropriately determined before the calculation in an optimization technique.

Figure 2:
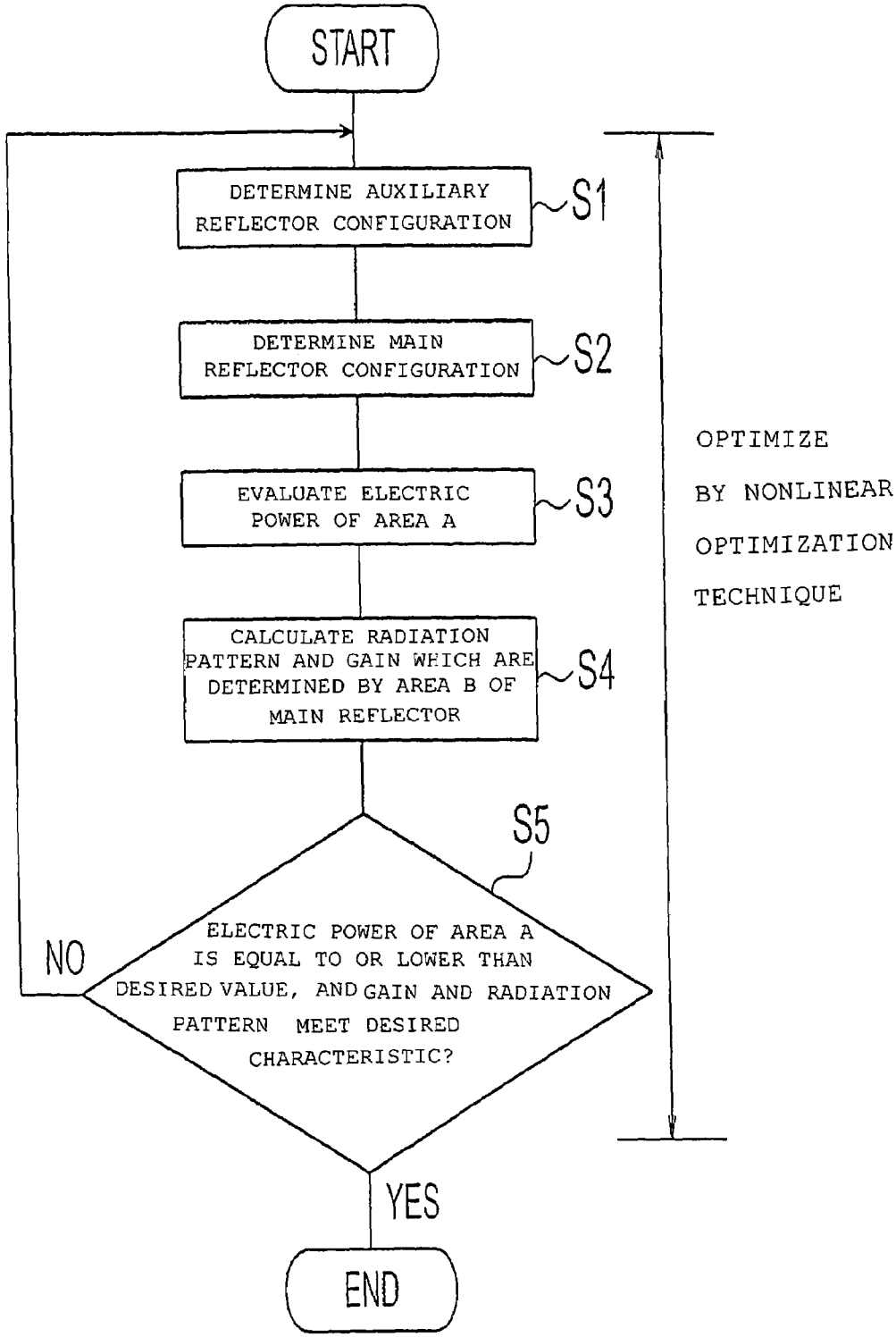
FIG. 2 is a flowchart showing a flow of processing of determining the configurations of an auxiliary reflector and a main reflector in the reflector antenna device in accordance with the first embodiment of the present invention.

FIG. 2 shows a designing procedure in accordance with this embodiment. In designing the antenna so as to obtain the desired characteristic in the designing procedure, calculation is repeated by a nonlinear optimization technique for optimization. The optimization based on a genetic algorithm (Yahya Rahmat-Samii, Electromagnetic Optimization by Genetic Algorithm, John Wiley & Sons, Inc) is also effective as the optimization technique.

Figure 12:
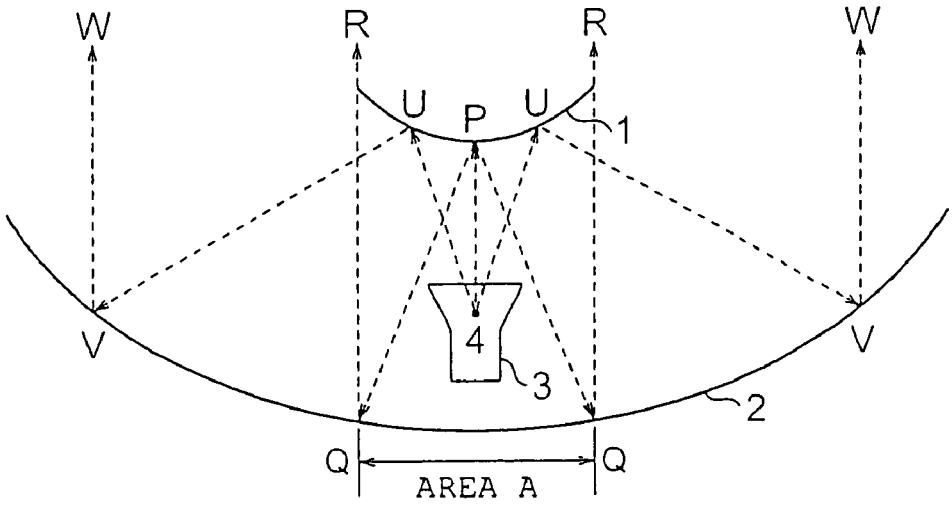
FIG. 12 Background Art
FIG. 12 is an explanatory diagram showing the structure of a conventional reflector antenna device.

In the designing procedure according to this embodiment, as shown in FIG. 2, the configuration of an auxiliary reflector 1 is first determined (Step S1). As a determining method, for example, a given function is given, a numeric number is appropriately inserted into the parameter of the function to determine the configuration of the auxiliary reflector 1. The selection of the function makes it possible to select various configurations such as a simple convex mirror shown in FIG. 12 or concave/convex portions on the surface configuration shown in FIG. 1. Then, the configuration of the main reflector 2 is determined in the same method (Step S2). Then, the electromagnetic wave in the area A is calculated to evaluate the power in the area A (Step S3). The electromagnetic wave should not arrive in the area A geometrically, but the electromagnetic wave is caused to arrive in the area A due to the wave property of the electromagnetic wave in fact, and the deterioration of the performance of the antenna is induced by the electromagnetic wave. Therefore, if the configurations of the auxiliary reflector 1 and the main reflector 2 can be selected so as to suppress the electromagnetic wave as much as possible, the deterioration of the performance of the antenna can be suppressed.

Then, the gain and radiation pattern of the antenna characteristic which are determined by the electromagnetic wave that arrives in the area B of the main reflector 2 other than the area A (Step S4). If the configurations of the auxiliary reflector 1 and the main reflector 2 can be selected so as to obtain the desired gain and radiation pattern of the antenna characteristic, the performance of the antenna can be improved.

Then, it is judged whether a power in the area A which is obtained in Step S3 is equal to or lower than a predetermined value, and the gain and radiation pattern of the antenna characteristic which are obtained in Step S4 meet a desired predetermined characteristic, or not (Step S5). In the case where it is judged that those two conditions are not met in Step S5, the process is returned to the beginning of the processing shown in FIG. 2, and the configurations of the auxiliary reflector 1 and the main reflector 2 are changed through Steps S and S2, and the same processing is conducted. In this way, calculation is repeatedly conducted in the nonlinear optimization technique for optimization until the two conditions can be met.

Hereinafter, an example of the configuration of the reflector surface that is determined in Step S and Step S2 above will be described. First, as shown in FIG. 1(*b*), a coordinate system is taken, and an initial configuration of the reflector antenna is determined. The coordinates of the auxiliary reflector 1 and the main reflector 2 are defined in a polar coordinate system, and it is assumed that a potential angle between the origin and an end portion of the auxiliary reflector 1 is $\theta_0$. The auxiliary reflector coordinates $P^0_s(\theta, \Phi)$ are represented by the following expression from the distance $r_0(\theta, \Phi)$ from the origin and direction vector $\hat{e}_r$ (or $e_r$ hat) on the auxiliary reflector 1 from the origin.

$$P_s^0(\theta, \phi) = r_0(\theta, \phi)\hat{e}_r \ \{0 \le \theta \le \theta_0, 0 \le \phi \le 2\pi\} \tag{1}$$

$$\hat{e}_r = (\sin\theta\cos\phi, \sin\theta\sin\phi, \cos\theta) \tag{2}$$

$$\hat{n}_s = \frac{\dfrac{\partial P_s^0(\theta, \phi)}{\partial\theta} \times \dfrac{\partial P_s^0(\theta, \phi)}{\partial\phi}}{\left| \dfrac{\partial P_s^0(\theta, \phi)}{\partial\theta} \times \dfrac{\partial P_s^0(\theta, \phi)}{\partial\phi} \right|} \tag{3}$$

where $\hat{n}_s$ (or $n_s$ hat) is a normal vector on the auxiliary reflector 1. The coordinates $P^0{}_m(\theta, \Phi)$ of the main reflector 2 are represented by the following expression on the basis of a reflecting direction $\hat{e}_s$ (or $e_s$ hat) in the auxiliary reflector 1, and a distance $S_0(\theta, \Phi)$ of from a point on the auxiliary reflector 1 to a point on the main reflector 2.

$$P_m{}^0(\theta, \phi) = P_s{}^0(\theta, \phi) + s_0(\theta, \phi)\hat{e}_s \tag{4}$$

$$\hat{e}_s = \hat{e}_r - 2(\hat{n}_s \cdot \hat{e}_r)\hat{n}_s \tag{5}$$

The configurations of the reflectors are determined by giving the distances $r_0(\theta, \Phi)$ and $S_0(\theta, \Phi)$. However, $r_0(\theta, \Phi)$ and $S_0(\theta, \Phi)$ may be defined as initial values in such a manner that the auxiliary reflector has a hyperboloid or an elliptical curved surface, or the main reflector has a paraboloidal surface, as in a Cassegrain antenna or a Gregorian antenna.

Then, in order to express the configurations of various reflectors, new auxiliary reflector coordinates $Ps(\theta, \Phi)$ and main reflector $Pm(\theta, \Phi)$ which are obtained by adding the following displacements to the initial configurations are regulated by the following expressions.

$$P_s(\theta, \phi) = P_s^0(\theta, \phi) + r(\theta, \phi)\hat{e}_r \tag{6}$$

$$r(\theta, \phi) = \sum_{m=0}^{M-1}\sum_{n=0}^{N-1} f_{mn} J_m(\lambda_m\theta/\theta_0)\cos n\phi \tag{7}$$

$$P_m(\theta, \phi) = P_m^0(\theta, \phi) + s(\theta, \phi)\hat{e}_s \tag{8}$$

$$s(\theta, \phi) = \sum_{m=0}^{M-1}\sum_{n=0}^{N-1} g_{mn} J_m(\lambda_m\theta/\theta_0)\cos n\phi \tag{9}$$

where $\lambda_m$ is an initial root of a m-order first Bessel function, meets $P_s(\theta_0, \Phi)=P_m(\theta_0, \Phi)=0$, and means that it holds the positions of the auxiliary reflector 1 and the main reflector 2. The reflector antennas of various configurations can be represented by changing the coefficients $f_{mn}$ and $g_{mn}$ of the respective functions which define the auxiliary reflector configuration and the main reflector configuration.

When the configuration of the reflector antenna is defined, an electric power of the area A in Step S3 and the gain and radiation pattern in Step S4 can be obtained by using the physical optics method. In the case where optimization is conducted using the genetic algorithm, and in the case where when a certain parameter is determined, an evaluation function with respect to the determined parameter is defined, a parameter that makes the evaluation function maximum can be obtained. Therefore, in Step S5, the evaluation function is regulated to be within a difference when the gain and the radiation pattern take desired values, and the electric power of the area A is equal to or lower than a desired value. As the evaluation function, $E_{all}$ is defined as represented by the following expression.

$$E_{all} = E_{gain} + E_{pat} + E_{blocking} \tag{10}$$

$E_{gain}$=an evaluation function defined by a gain (11)

$E_{pat}$=an evaluation function defined by a pattern (12)

$E_{blocking}$=an evaluation function defined by an electric power of the auxiliary shielding area (area A) (13)

where the following functions are defined.

$$\begin{aligned} u(x) &= A_1(x - x_b) + B_1 && (x \leqq x_b) \\ &= B_1 && (x > x_b) \\ & && (A_1 \text{ is a positive value}) \end{aligned} \tag{14}$$

$$\begin{aligned} v(x) &= B_1 && (x \leqq x_b) \\ &= A_1(x - x_b) + B_1 && (x > x_b) \\ & && (A_1 \text{ is a positive value}) \end{aligned} \tag{15}$$

u(x) is a function that monotonically increases by $A_1$ in an area of $x_b$ or less, and takes a constant value $B_1$ in an area of $x_b$ or more, and v(x) is a function that takes a constant value $B_1$ in an area of $x_b$ or less, and monotonically decreases by $A_1$ in an area of $x_b$ or more. Therefore, the function u(x) is used to realize an argument of a constant value or more, and the function V(x) is used to realize an argument of the constant value or less. For example, the function u(x) is used to set the gain to a desired value or more, and the function v(x) is used in order to set the radiation pattern to a specified pattern or less, and set the electric power of the area A to a desired value or less.

Assuming that a gain value of the shaped reflector surface which is determined by a certain parameter is g, and a target value of the gain is $g_{target}$, the evaluation function $E_{gain}$ can be defined as follows.

$$E_{gain} = u(g) \tag{16}$$

(where $A_1$ and $B_1$ are appropriate values, and $x_b = g_{target}$).

Also, assuming that the evaluation score of the radiation pattern is $N_{pat}$, the side lobe levels at the respective evaluation points are $s_i$(i=1, . . . , $N_{pat}$), and the target value is $s_{target}$, the evaluation function $E_{pat}$ can be defined as follows:

$$E_{pat} = \sum_{i=1}^{N_{pat}} v(s_i) \tag{17}$$

(where $A_1$ and $B_1$ are appropriate values, and $x_b = s_{target}$).

In the case where side lobe mask of the antenna is defined, the target value may be set to a mask pattern per se or a mask pattern with a slight margin.

Also, assuming that the evaluation score of the electric power of the auxiliary reflector shielding area is $N_{blocking}$, the electric powers at the respective evaluation points are $p_i(i=1, \ldots, N_{blocking})$, and the target value is $p_{blocking}$, the evaluation function $E_{blocking}$ can be defined as follows:

$$E_{blocking} = \sum_{i=1}^{N_{blocking}} v(p_i) \tag{18}$$

(where $A_1$ and $B_1$ are appropriate values, and $x_b = P_{blocking}$).

In the above, it is necessary to appropriately determine the values of A1 and B1 based on the importance of the respective evaluation functions at the respective evaluation functions. The reflector surface parameter that sets the gain to a desired value or more, the radiation pattern to a specified pattern or less, and the electric power of the area A to a desired value or less, that is, the reflector surface configuration can be determined by optimizing the evaluation function by means of the genetic algorithm.

As described above, according to this embodiment, the calculation is repeated until the electric power of the area A becomes a predetermined value or less, and the gain and radiation pattern of the antenna characteristic can meet desired predetermined characteristics, to thereby determine the configurations of the auxiliary reflector 1 and the main reflector 2. Accordingly, the reflector antenna that has the characteristic of a high performance and minimizes the deterioration of the antenna performance can be obtained.

When the reflector antenna is downsized, the size of the auxiliary reflector becomes small in the wavelength ratio. Therefore, although the electric wave is usually liable to arrive in the area A, when the antenna is desired in the setting procedure shown in FIG. 2 according to this embodiment, the deterioration of the performance can be suppressed. As described above, this embodiment is particularly effective to a small-size reflector antenna that is liable to induce the deterioration of the performance.

SECOND EMBODIMENT

Figure 3:
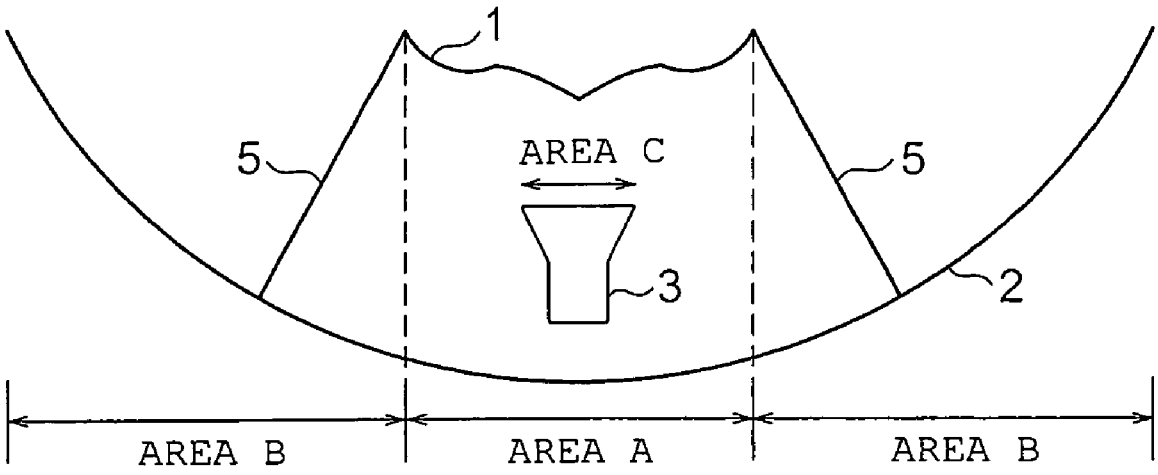
FIG. 3 is an explanatory diagram showing the structure of the reflector antenna device in accordance with a second embodiment of the present invention.
Figure 4:
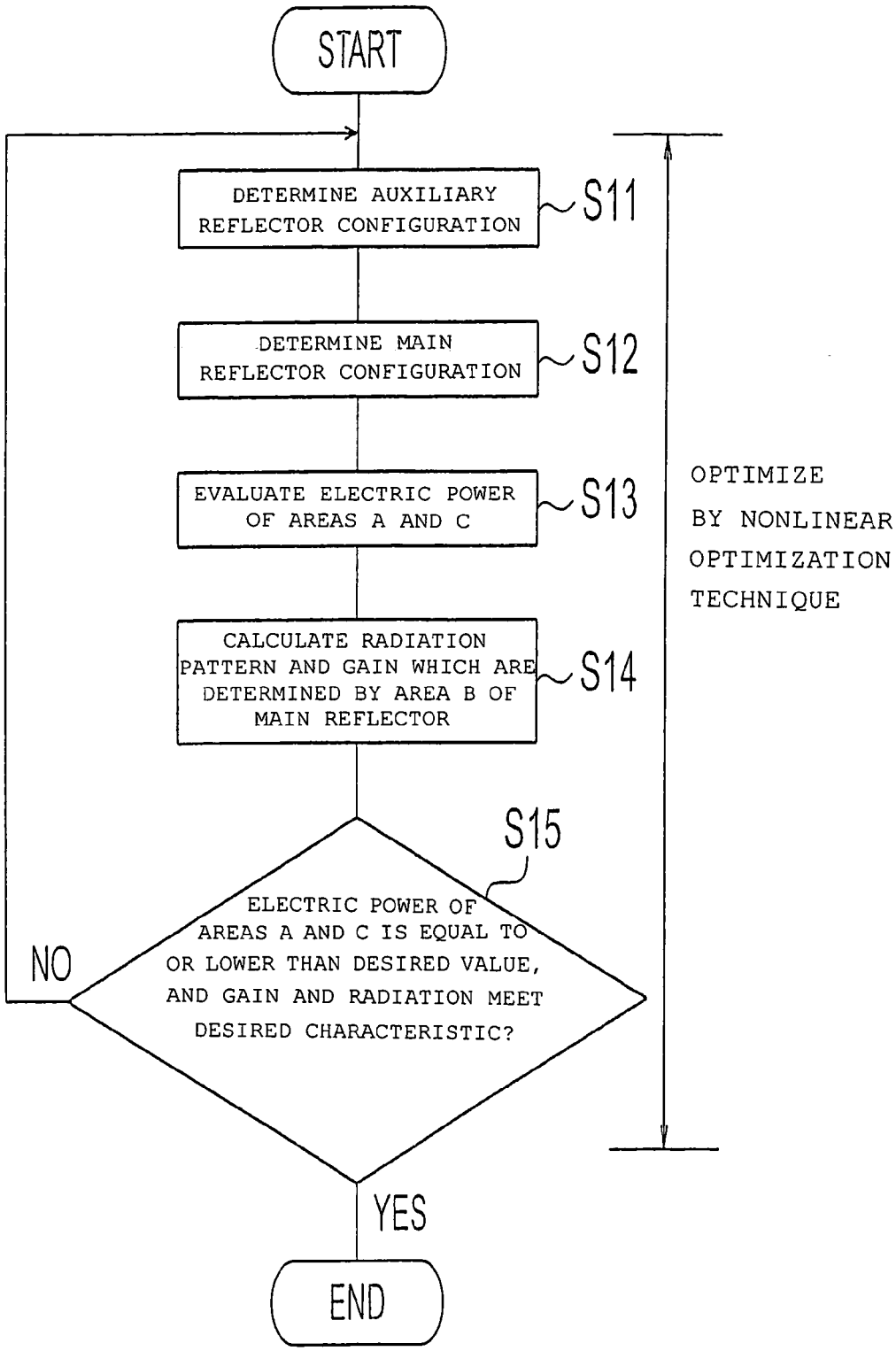
FIG. 4 is a flowchart showing a flow of processing of determining the configurations of the auxiliary reflector and the main reflector in the reflector antenna device in accordance with the second embodiment of the present invention.

FIG. 3 shows the structure of a reflector antenna in accordance with the first embodiment, and FIG. 4 shows a designing procedure thereof. In the above-mentioned first embodiment, only a reduction in the electric power in the area A is considered. On the other hand, a feature of this embodiment resides in, instead of the reduction in the electric power of the area A, the antenna design that is conducted taking into consideration a reduction in the electric power on an opening surface (or an opening portion, an area C of FIG. 3) of the primary radiator 3, or a reduction in the electric power of both areas of the area A and the area C. In the following description, the antenna design made by taking into consideration the reduction in the electric power of both the areas A and C will be described.

As shown in FIG. 3, the structure of the reflector antenna according to this embodiment is fundamentally identical with those shown in FIG. 1 as described above, and therefore a description thereof will be omitted.

Then, the designing procedure according to this embodiment will be described with reference to FIG. 4. In the designing procedure according to this embodiment, as shown in FIG. 4, the configuration of the auxiliary reflector 1 is first determined (Step S11). The determining method is identical with that described above. Then, the configuration of the main reflector 2 is determined according to the same method (Step S12). Then, the electromagnetic wave of the area A and the area C is measured to evaluate the electric power of the area A and the area C (Step S13). In the area C, because a scattering wave is generated by the primary radiator 3, an undesirable contribution occurs and induces the deterioration of the antenna characteristics. Therefore, if the configurations of the auxiliary reflector 1 and the main reflector 2 can be selected so as to suppress the generation of the scattering wave as much as possible, the deterioration of the antenna performance can be suppressed. Regarding the area A, the above description of the first embodiment is applied. Then, the gain and radiation pattern of the antenna characteristics which are determined by the electromagnetic wave that arrives in the area B of the main reflector 2 other than the area A are calculated (Step S14). This calculation is identical with that described in the above first embodiment. Then, it is judged whether the electric powers of the areas A and C which are obtained in Step S13 take a predetermined value or less, and the gain and radiation pattern of the antenna characteristics which are obtained in Step S14 obtain predetermined desired characteristics, or not (Step S15). In the case where it is judged that those two conditions are not met in Step S15, the process is returned to the beginning of the processing shown in FIG. 4, and the configurations of the auxiliary reflector 1 and the main reflector 2 are changed by Steps S11 and S12, and the same processing is conducted. In this manner, the calculation is repeatedly conducted in the nonlinear optimization technique for optimization until the two conditions can be met.

As described above, similarly in this embodiment, since the design of the antenna is optimized by the nonlinear optimization technique, it is possible to obtain the reflector antenna that has the characteristic of a high performance and minimizes the deterioration of the antenna performance. In this embodiment, the deterioration of the performance which is attributable to the scattering wave due to the primary radiator 3 is taken into consideration. This is particularly effective when the reflector antenna is downsized and a distance between the primary radiator 3 and the auxiliary reflector 1 becomes shorter.

THIRD EMBODIMENT

Figure 5:
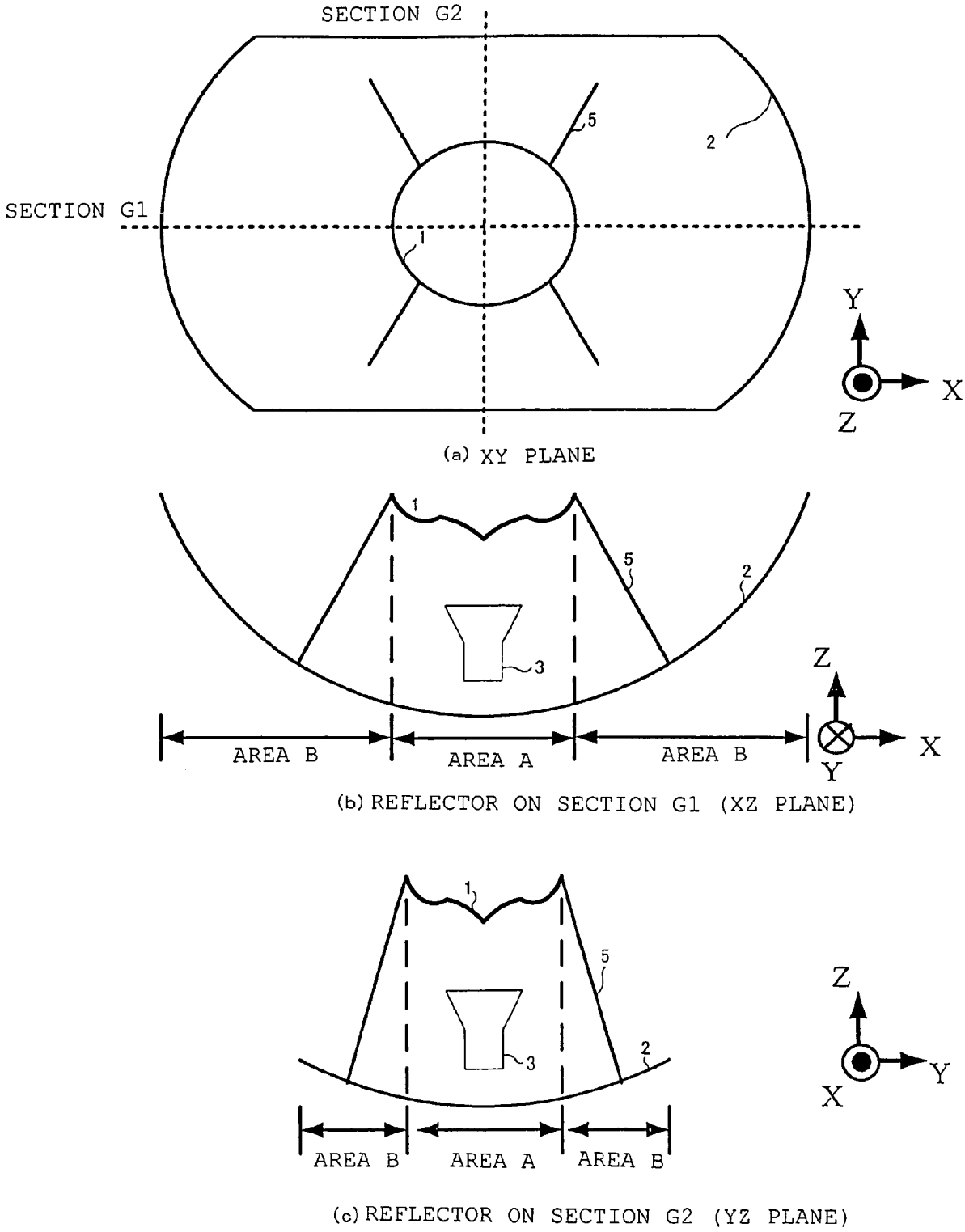
FIG. 5(*a*) is a projection view showing the structure of a reflector antenna device in accordance with a third embodiment of the present invention, FIG. 5(*b*) is a cross-sectional view taken along a section G1 thereof, and FIG. 5(*c*) is a cross-sectional view taken along a section G2 thereof.

A reflector antenna device according to a third embodiment of the present invention will be described. This embodiment provides an asymmetric reflector antenna device and is directed to realize an antenna of a high performance using the same designing method as that of the first embodiment. FIG. 5(*a*) is a projection view of an antenna as viewed from a Z-axis direction. FIG. 5(*b*) shows a section G1 of FIG. 5(*a*), and FIG. 5(*c*) shows a section G2 of FIG. 5(*a*).

Figure 6:
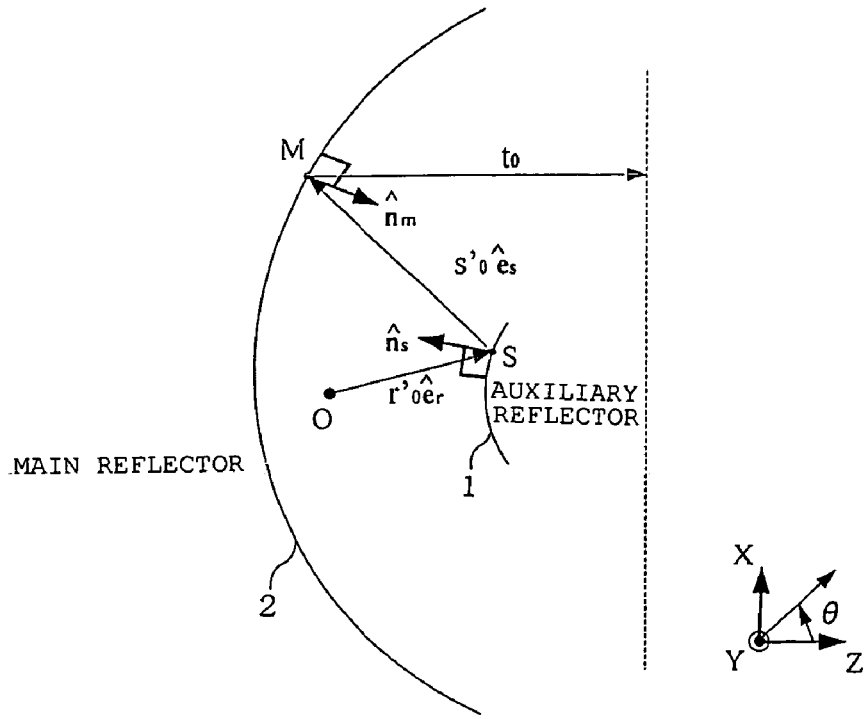
FIG. 6(*a*) is an explanatory diagram showing an initial configuration and a coordinate system of an XZ plane of the reflector antenna device in accordance with the third embodiment of the present invention, and FIG. 6(*b*) is an explanatory diagram showing an initial configuration and a coordinate system of a YZ plane thereof.
Figure 6:
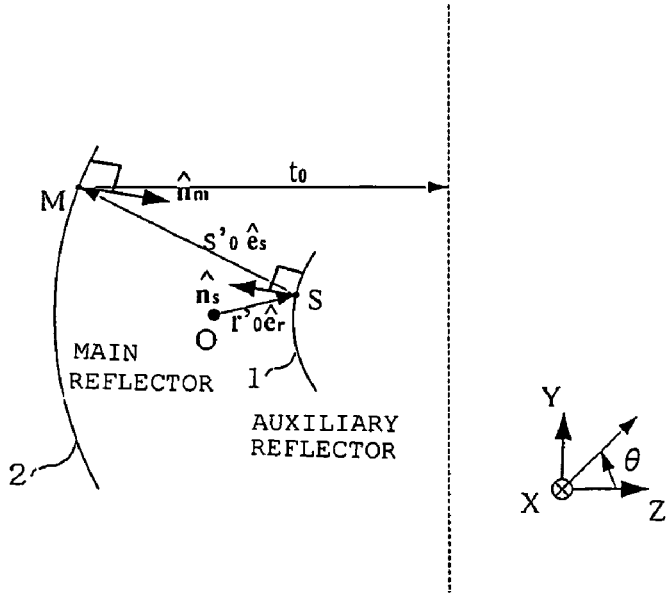

The designing procedure is identical with that described in the first embodiment with reference to FIG. 2, but in order to realize asymmetric reflector antenna device, a coordinate system is taken as shown in FIG. 6, and the initial configurations of the auxiliary reflector 1 and the main reflector 2 are determined. The coordinates of the auxiliary reflector 1 and the main reflector 2 are defined by a polar coordinate system, and it is assumed that a potential angle between the origin and an end portion of the auxiliary reflector 1 is $\theta_0$. The auxiliary reflector coordinates $P^0_s(\theta, \Phi)$ is represented by the following expression on the basis of a distance $r_0(\theta,$ Φ) from the origin and a direction vector $\hat{e}_r$ (or $e_r$ hat) on the auxiliary reflector 1.

$$P_s^0(\theta, \phi) = r_0'(\theta, \phi)\hat{e}_r \ \{0 \le \theta \le \theta_0, 0 \le \phi \le 2\pi\} \tag{19}$$

$$\hat{e}_r = (\sin\theta\cos\phi, \sin\theta\sin\phi, \cos\theta) \tag{20}$$

$$\hat{n}_s = \frac{\dfrac{\partial P_s^0(\theta, \phi)}{\partial\theta} \times \dfrac{\partial P_s^0(\theta, \phi)}{\partial\phi}}{\left| \dfrac{\partial P_s^0(\theta, \phi)}{\partial\theta} \times \dfrac{\partial P_s^0(\theta, \phi)}{\partial\phi} \right|} \tag{21}$$

where $\hat{n}_s$ (or $n_s$ hat) is a normal vector on the auxiliary reflector 1. The coordinates $P^0{}_m(\theta, \Phi)$ of the main reflector 2 are represented by the following expression on the basis of a reflecting direction $\hat{e}_s$ (or $e_s$ hat) in the auxiliary reflector 1, and a distance $S_0(\theta, \Phi)$ of from a point on the auxiliary reflector 1 to a point on the main reflector 2.

$$P_m{}^0(\theta, \phi) = P_s{}^0(\theta, \phi) + s'_0(\theta, \phi)\hat{e}_s \tag{22}$$

$$\hat{e}_s = \hat{e}_r - 2(\hat{n}_s \cdot \hat{e}_r)\hat{n}_s \tag{23}$$

where the distances $r'_0(\theta, \Phi)$ and $S'_0(\theta, \Phi)$ are different depending on the value of Φ and determined so as to realize the asymmetric reflector surface.

For example, it is possible to use the reflector surface designed by the geometric optics technique, which is an asymmetric reflector surface and whose path "$r'_0(\theta, \Phi)+S'_0(\theta, \Phi)+t_0$" geometrical-optically determined becomes constant. The reflector antenna may be designed with respect to the reflector antenna of the initial configuration in accordance with the designing procedure shown in FIG. 2. Because the development function of the expressions (6) to (9) used in the first embodiment, and the evaluation function of the expression (10) to the expression (13), the expression (16), the expression (17), and the expression (18) can be used as they are, and the antenna is an asymmetric reflector antenna in the initial configurations of the reflector surface. Therefore, the asymmetric reflector can be designed.

In this embodiment, it is possible to obtain a high-performance reflector antenna that minimizes the deterioration of the antenna performance in the asymmetric reflector antenna as in the first embodiment. Also, this embodiment is particularly effective for a small-sized reflector antenna that is liable to induce the deterioration of the performance as in the first embodiment.

FOURTH EMBODIMENT

Figure 7:
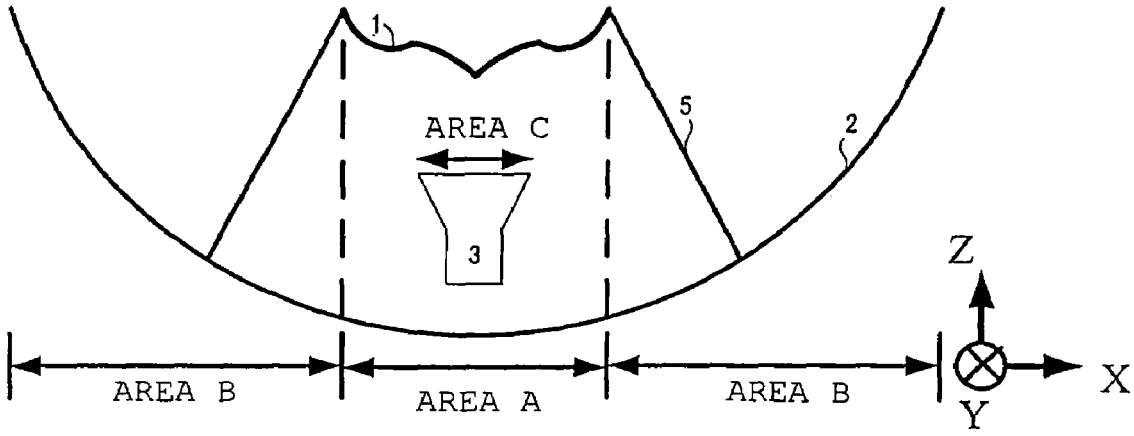
FIG. 7(*a*) is a cross sectional view taken along a section G1 of the structure of a reflector antenna device in accordance with a fourth embodiment of the present invention, and FIG. 7(*b*) is a cross sectional view taken along a section G2 thereof.
Figure 7:
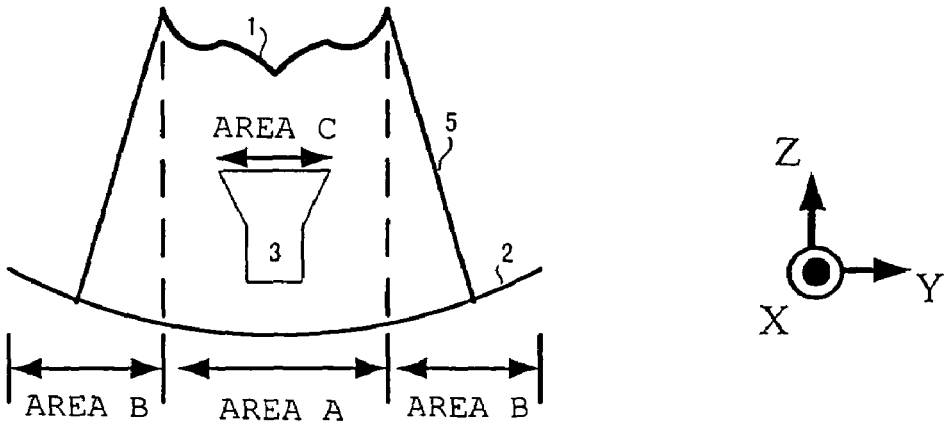

A reflector antenna device according to this embodiment will be described. This embodiment provides an asymmetric reflector antenna device and is directed to realize a high-performance antenna by using the same designing method as that of the second embodiment. That is, a feature of this embodiment resides in the antenna designed by taking into consideration a reduction in the electric power on an opening surface (or an opening portion, an area C of FIG. 7) of the primary radiator 3, or a reduction in the electric power of both areas A and C. FIG. 7(*a*) is a cross-sectional view taken along a section G1 of the antenna, and FIG. 7(*b*) is a cross-sectional view taken along a section G2 thereof. The projection view as viewed from the Z-axis direction of the antenna shown in FIG. 7 is referred to FIG. 5(*a*).

The designing procedure is described below while focused on a case in which a reduction in the electric power of both areas A and C is taken into consideration.

The designing procedure is identical with that described in the second embodiment with reference to FIG. 4, but in order to realize the asymmetric reflector antenna device, the fourth embodiment is different from the second embodiment in that the asymmetric reflector surface is realized such that the initial configurations of the auxiliary reflector 1 and the main reflector 2 are given by the above-expressions (19) to (21) and the above expressions (22) and (23), respectively, and by differing the distances $r'_0(\theta, \Phi)$ and $S'_0(\theta, \Phi)$ depending on the value of Φ.

In this embodiment, it is possible to obtain a high-performance reflector antenna that minimizes the deterioration of the antenna performance in the asymmetric reflector antenna as in the first embodiment. Also, this embodiment is particularly effective for a small-sized reflector antenna that is liable to induce the deterioration of the performance as in the first embodiment.

FIFTH EMBODIMENT

Figure 8:
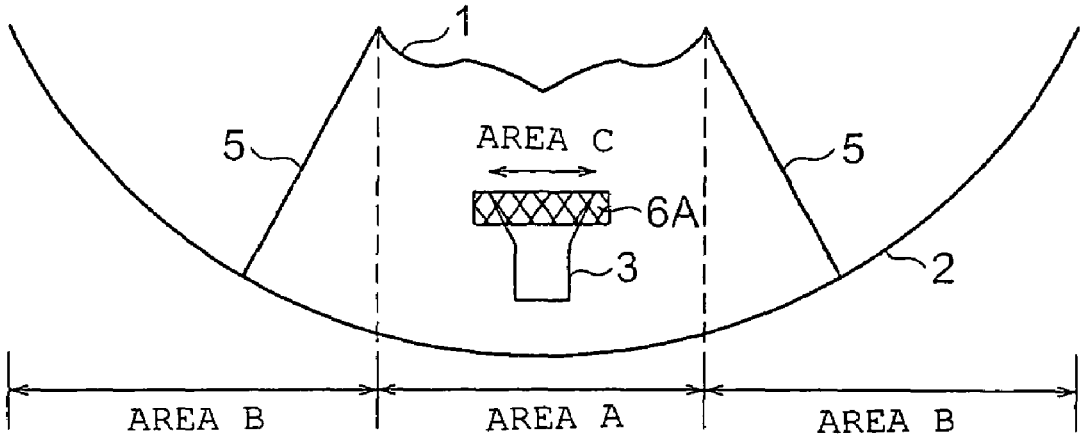
FIG. 8 is an explanatory diagram showing the structure of a reflector antenna device in accordance with a fifth embodiment of the present invention.

A reflector antenna device according to this embodiment will be described with reference to FIG. 8. This embodiment has a feature that an electric wave absorbing member 6A is mounted on the peripheral portion of the opening surface of the primary radiator 3. With this structure, since the electric wave that arrives at the opening surface of the primary radiator 3 can be absorbed by the electric wave absorbing member 6A, the scattering wave can be suppressed from occurring due to the main reflector 3, and the deterioration of the performance due to the scattering wave can be suppressed. Other structures are identical with those in the above first or second embodiment, and their description will be omitted in this example. The configurations of the auxiliary reflector 1 and the main reflector 2 are determined according to any designing procedure of the above first and second embodiments.

As described above, in this embodiment, since the electric wave absorbing member 6A is disposed on the peripheral portion of the opening surface of the primary radiator 3 so as to suppress the electric power that is scattered at the opening surface of the primary radiator 3, there is advantageous in that the deterioration of the antenna performance can be suppressed.

The reflector antenna device according to this embodiment is particularly effective when the device is downsized, and a distance between the primary radiator 3 and the auxiliary reflector 1 becomes shorter.

SIXTH EMBODIMENT

Figure 9:
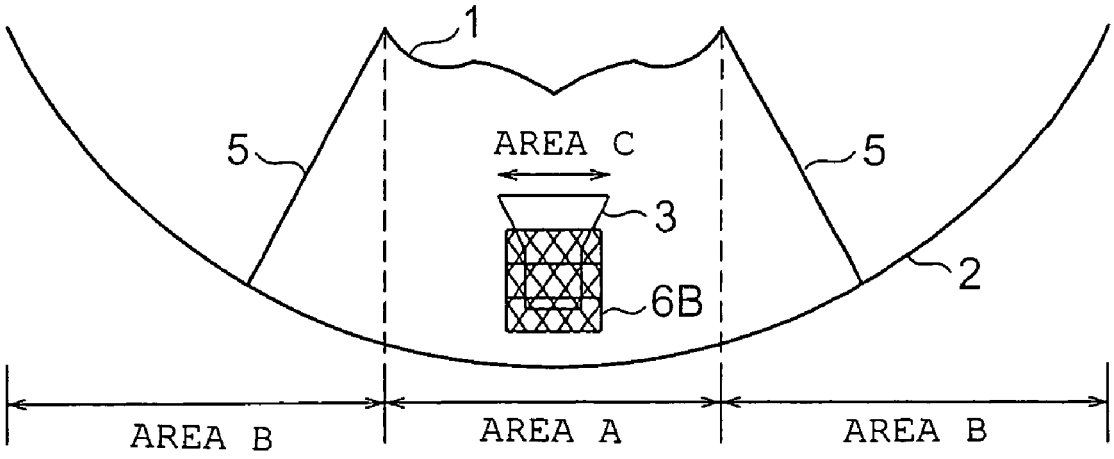
FIG. 9 is an explanatory diagram showing the structure of a reflector antenna device in accordance with a sixth embodiment of the present invention.

A reflector antenna device according to this embodiment will be described with reference to FIG. 9. This embodiment has a feature that an electric wave absorbing member 6B is mounted on the side surface of the primary radiator 3. With this structure, since the scattering wave generated by the electric wave that arrives at the side surface of the primary radiator 3 can be absorbed by the electric wave absorbing member 6B, the deterioration of the performance due to the scattering wave can be suppressed. Other structures are identical with those in the above first or second embodiment, and their description will be omitted in this example. The configurations of the auxiliary reflector 1 and the main reflector 2 are determined according to any designing procedure of the above first and second embodiments.

As described above, in this embodiment, since the electric wave absorbing member 6B is disposed on the side surface of the primary radiator 3 so as to suppress the electric power that is scattered at the opening surface of the primary radiator 3, there is advantageous in that the deterioration of the antenna performance can be suppressed.

The reflector antenna device according to this embodiment has such an effect that the deterioration of the performance resulting from the scattering wave due to the primary radiator 3 can be particularly suppressed when the device is downsized, and a distance between the primary radiator 3 and the auxiliary reflector 1 becomes smaller.

SEVENTH EMBODIMENT

A reflector antenna device according to this embodiment will be described with reference to FIG. 10. This embodiment has a feature that an electric wave absorbing member 6C is disposed on an area A where the auxiliary reflector 1 is projected onto the main reflector 2. With this structure, since a multiple reflected wave between the main reflector 2 and the auxiliary reflector 1 in the area A can be absorbed by the electric wave absorbing member 6C, the deterioration of the performance that is attributable to the multiple reflected wave can be suppressed. Other structures are identical with those in the above first or second embodiment, and their description will be omitted in this example. The configurations of the auxiliary reflector 1 and the main reflector 2 are determined according to any designing procedure of the above first and second embodiments.

As described above, in this embodiment, since the electric wave absorbing member 6C is disposed in the area A so as to suppress the multiple reflected wave between the area A and the auxiliary reflector 1, there is advantageous in that the deterioration of the antenna performance can be suppressed.

The reflector antenna device according to this embodiment is particularly effective when the device is downsized, and a distance between the main reflector 2 and the auxiliary reflector 1 becomes smaller. Even in this case, the high-performance antenna can be realized.

Figure 10:
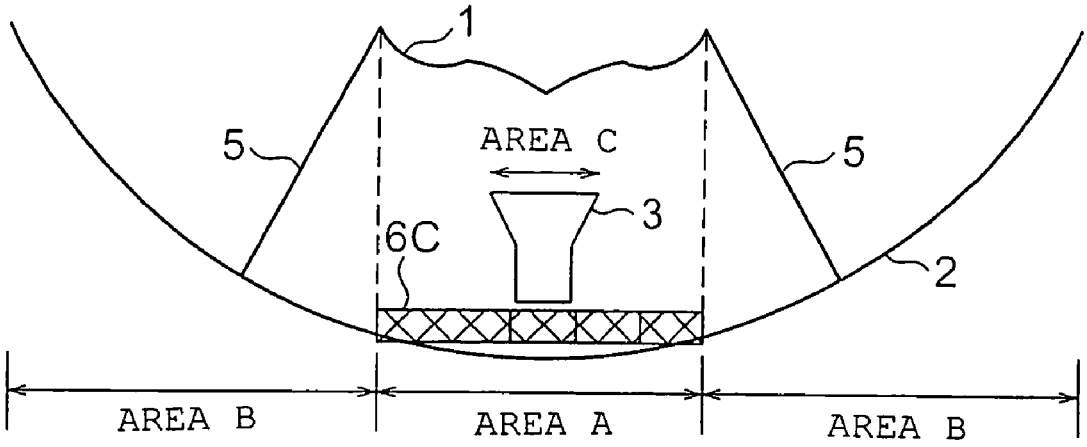
FIG. 10 is an explanatory diagram showing the structure of a reflector antenna device in accordance with a seventh embodiment of the present invention.

In the example of FIG. 10, the electric wave absorbing member 6C is shaped in a plate, but the present invention is not limited to this, but the electric wave absorbing member 6C may be disposed along the surface of the area A.

EIGHTH EMBODIMENT

Figure 11:
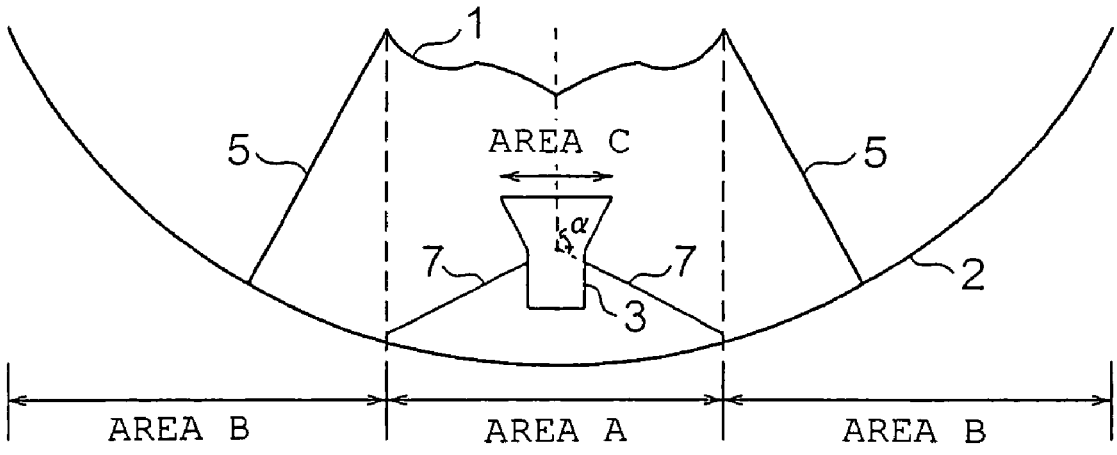
FIG. 11 is an explanatory diagram showing the structure of a reflector antenna device in accordance with an eighth embodiment of the present invention.

A reflector antenna device according to this embodiment will be described with reference to FIG. 11. This embodiment has a feature that a reflecting plate 7 that is made up of a metal plate for reflecting an electromagnetic wave or the like is disposed with a predetermined slope with respect to the radiation direction of the electric wave due to the primary radiator 3 on the area A where the auxiliary reflector 1 is projected on to the main reflector 2. The predetermined slope is appropriately set so that the value of $\alpha$ is in a range of $90° \leqq \alpha \leqq 180°$ assuming that an angle defined between the radiating direction of the electric wave from the primary radiator 3 and the reflecting plate 7 (or an extension of the reflecting plate 7) is $\alpha$, for example, as shown in FIG. 11. With this structure, since the electromagnetic wave that arrives in the area A can be reflected by the reflecting plate 7 in a direction other than the direction of the auxiliary reflector 1 in the reflector antenna of this embodiment, there is advantageous in that a multiple reflection between the area A and the auxiliary reflector 1 is suppressed, and the deterioration of the antenna performance can be suppressed.

The reflector antenna device according to this embodiment is particularly effective when the device is downsized, and a distance between the main reflector 2 and the auxiliary reflector 1 becomes smaller. Even in this case, the high-performance antenna can be realized.

NINTH EMBODIMENT

In the above first and second embodiments, an example of determining the configurations of the auxiliary reflector 1 and the main reflector 2 in Steps S1 and S2 is described. The present invention is not limited to this case, but, for example, it is possible that the configuration of the main reflector 2 is fixed, and only the configuration of the auxiliary reflector 1 is optimized by the nonlinear optimization technique. Conversely, the configuration of the auxiliary reflector 1 may be fixed. In this case, the same effects as those in the above first or second embodiment can be obtained. In addition, since a process of determining the configuration of any one of the reflectors is unnecessary, a calculation load can be reduced.

Also, since the above fifth, sixth, and seventh embodiments or the five, sixth, and eighth embodiments may be appropriately combined with each other. In this case, since the electromagnetic wave can be further suppressed, the performance of the antenna can be further enhanced.

The invention claimed is:

1. A reflector antenna device, comprising:

an auxiliary reflector that receives an electric wave radiated from an opening portion by a primary radiator and reflects the electric wave; and a main reflector that receives the electric wave that is reflected by the auxiliary reflector and radiates the electric wave to a space, characterized in that the configurations of the auxiliary reflector and the main reflector are designed such that an electric power in an area of the main reflector where the auxiliary reflector is projected on the main reflector in parallel with the radiating direction of the electric wave due to the main reflector is equal to or lower than a predetermined first threshold value, and a radiation pattern of the antenna which is determined by the area of the main reflector other than the area has a desired characteristic.

2. A reflector antenna device according to claim 1, characterized in that an electric wave absorbing member for absorbing the electric wave is disposed on a peripheral portion of the opening portion of the primary radiator.

3. A reflector antenna device according to claim 1, characterized in that an electric wave absorbing member for absorbing the electric wave is disposed on a side surface of the primary radiator.

4. A reflector antenna device according to claim 1, characterized in that an electric wave absorbing member for absorbing the electric wave is disposed on the area of the main reflector where the auxiliary reflector is projected on the main reflector in parallel with the radiating direction of the electric wave due to the main reflector.

5. A reflector antenna device according to claim 1, characterized in that a metal plate for reflecting an electric wave that arrives in the area of the main reflector where the auxiliary reflector is projected on the main reflector in parallel with the radiating direction of the electric wave due to the main reflector in a direction other than the direction of the auxiliary reflector is disposed on the area with a slope that is 90° or more and 180° or less with respect to the radiation direction of the electric wave.

6. A reflector antenna device, comprising:

an auxiliary reflector that receives an electric wave radiated from an opening portion by a primary radiator and reflects the electric wave; and a main reflector that receives the electric wave that is reflected by the auxiliary reflector and radiates the electric wave to a space, characterized in that the configurations of the auxiliary reflector and the main reflector are designed such that an electric power on the opening portion of the primary radiator is equal to or lower than a predetermined second threshold value, and a radiation pattern of the antenna which is determined by another area of the main reflector other than an area of the main reflector where the auxiliary reflector is projected on the main reflector in parallel with the radiating direction of the electric wave due to the main reflector has a desired characteristic.

7. A reflector antenna device, comprising:

an auxiliary reflector that receives an electric wave radiated from an opening portion by a primary radiator and reflects the electric wave; and a main reflector that receives the electric wave that is reflected by the auxiliary reflector and radiates the electric wave to a space, characterized in that the configurations of the auxiliary reflector and the main reflector are designed such that an electric power in an area of the main reflector where the auxiliary reflector is projected on the main reflector in parallel with the radiating direction of the electric wave due to the main reflector is equal to or lower than a predetermined first threshold value, an electric power on an opening portion of the primary radiator is equal to or lower than a predetermined second threshold value, and a radiation pattern of the antenna which is determined by the area of the main reflector other than the area has a desired characteristic.

* * * * *